US006778376B2

(12) United States Patent
Soper

(10) Patent No.: US 6,778,376 B2
(45) Date of Patent: Aug. 17, 2004

(54) STATIC ARC DISSIPATION DEVICE

(76) Inventor: Joshua Scott Soper, 8314 Banyan Blvd., Orlando, FL (US) 32819

( * ) Notice: Subject to any disclaimer, the term of this patent is extended or adjusted under 35 U.S.C. 154(b) by 88 days.

(21) Appl. No.: 10/063,168

(22) Filed: Mar. 27, 2002

(65) Prior Publication Data

US 2003/0184947 A1 Oct. 2, 2003

(51) Int. Cl.[7] ..... H01H 47/00; H05F 3/00
(52) U.S. Cl. ..... 361/220; 361/216
(58) Field of Search ..... 361/212, 220, 361/216

(56) References Cited

U.S. PATENT DOCUMENTS 2,858,482 A * 10/1958 Nutter ..... 361/216
3,935,508 A * 1/1976 Moister, Jr. ..... 361/222
4,334,259 A * 6/1982 Edwards ..... 361/212
5,222,013 A * 6/1993 Schwalm ..... 361/212
5,335,137 A * 8/1994 English et al. ..... 361/220
6,459,560 B1 * 10/2002 Beribisky ..... 361/220

FOREIGN PATENT DOCUMENTS

EP WO 94/01305 * 1/1994 ..... B60R/16/06

* cited by examiner

*Primary Examiner*—Anthony Dinkins
*Assistant Examiner*—Eric Thomas

(57) ABSTRACT

This device is used to discharge static electricity painlessly prior to touching an object. The device places a resistive load in the circuit lowering the rate (voltage and current) of static discharges from the user's body into an object. This is done by pressing touch point (A), which is connected to the object. The device can be temporarily attached using a magnet or sticker.

1 Claim, 1 Drawing Sheet

STATIC ARC DISSIPATION DEVICE

BACKGROUND OF INVENTION

A common problem when entering and exiting a vehicle in dry cold climates is getting shocked. This is caused by ElectroStatic Discharge (ESD) between the person and the vehicle. In the electronics industry, a technician would protect the a circuit by having the static in their body discharge through a resistor. The pain involved with a static shock comes from the arc exiting the body.

DETAILED DESCRIPTION

Figure 1:
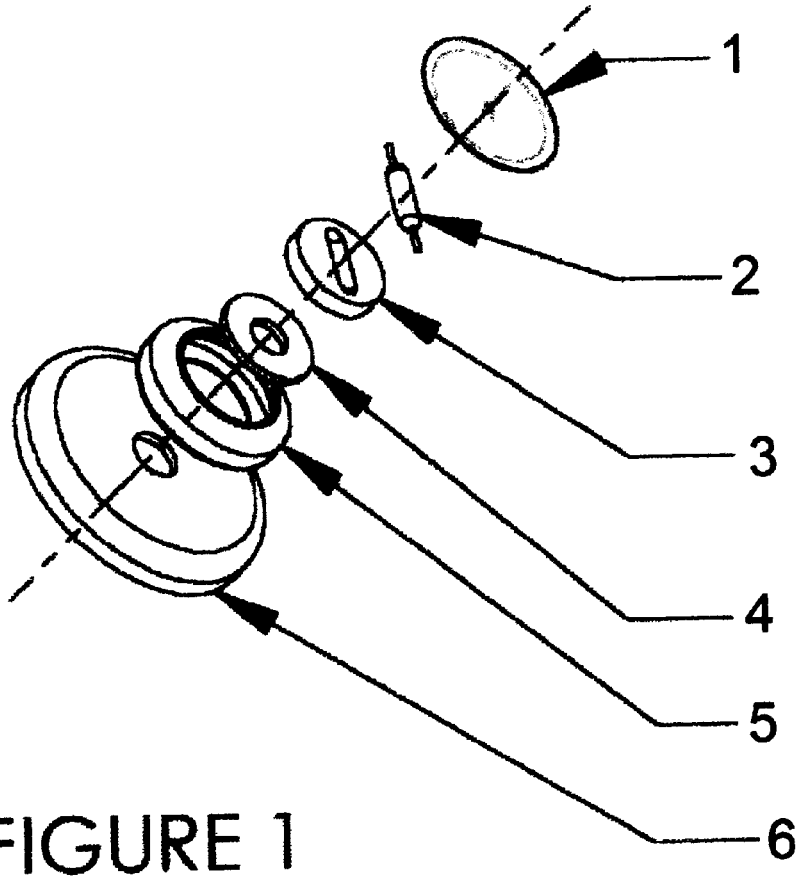
FIG. 1 shows an exploded view of the invention.

The invention consists of a touch point (1), resistive circuit (2), electrical isolator (3), contact plate (4), non-conductive spring/switch mechanism (5), and an attachment force typically a magnet or sticker (6). To use the invention place the device on any metal object where static shock is a common problem, such as the door of an automobile. The magnet or sticker (6) will hold the invention in place. Prior to touching the object (i.e. car) depress the touch point (1) on the invention. Any static will travel from the touch point (1) through the resistive circuit (2) and into the automobile's grounding system by way of the contact plate (4). The arc generated by the static will exit through the contact plate instead of the user's finger. This effectively eliminates the static in the body without feeling the pain of the arc of electricity leaving your fingers.

What is claimed is:

1. An electrostatic discharge device comprising:

a touch point;

a contact surface;

said contact surface is connected to said touch point by a resistive circuit;

said resistive circuit actuated by a non-conductive spring;

the electrostatic discharge device is attachable to a conductive surface by a magnet or sticker; thereby making the electrostatic discharge device removable, the electrostatic discharge device transfers an electrical charge from a human hand to the conductive surface.

* * * * *